United States Patent [19]

Gurney

[11] 4,256,261

[45] Mar. 17, 1981

[54] HIGHWAY STRIPING METHOD AND APPARATUS

[75] Inventor: Richard S. Gurney, Roseville, Minn.

[73] Assignee: H. B. Fuller Company, Saint Paul, Minn.

[21] Appl. No.: 98,526

[22] Filed: Nov. 29, 1979

Related U.S. Application Data

[63] Continuation of Ser. No. 832,642, Sep. 12, 1977, abandoned.

[51] Int. Cl.[3] ..... B05B 15/10; B05B 15/02

[52] U.S. Cl. ..... 239/155; 239/112; 239/150; 239/287

[58] Field of Search ..... 239/112, 130, 131, 150, 239/151, 155, 287; 427/137

[56] References Cited

U.S. PATENT DOCUMENTS

| | | | |
|---|---|---|---|
| 1,702,585 | 2/1929 | Bell | 239/150 |
| 2,673,090 | 3/1954 | Blumberg | 239/150 X |
| 2,746,072 | 5/1956 | Lumpkin | 239/287 X |
| 3,057,273 | 10/1962 | Wilson | 239/112 X |
| 3,162,369 | 12/1964 | Mitchell | 239/150 |
| 3,477,352 | 11/1969 | Harding et al. | 239/156 X |
| 3,682,054 | 8/1972 | MacPhail et al. | 239/130 |

*Primary Examiner*—Robert W. Saifer
*Attorney, Agent, or Firm*—Merchant, Gould, Smith, Edell, Welter & Schmidt

[57] ABSTRACT

The disclosed stripe-applying ("striping") method and apparatus for applying a curable coating composition (preferably the two-part type) to a paved surface comprises a movable vehicle suitable for traveling over that surface. The vehicle carries a first nozzle for applying a pressurized water spray to the paved surface, a second nozzle for applying an air blast to the paved surface, and a third nozzle for applying the coating composition under pressure to the section of the paved surface previously cleaned by the water spray and air blast. In addition, a glass bead applicator drops a plurality of glass beads onto the coating composition after it has been applied to the paved surface. The two components which comprise the coating composition are heated in a system having selectively operable valves for continuously circulating these components when a striping operation is not taking place. Furthermore, a system is provided for flushing the third nozzle and the lines containing the coating composition to remove gelled particles therefrom.

5 Claims, 8 Drawing Figures

FIG. 5
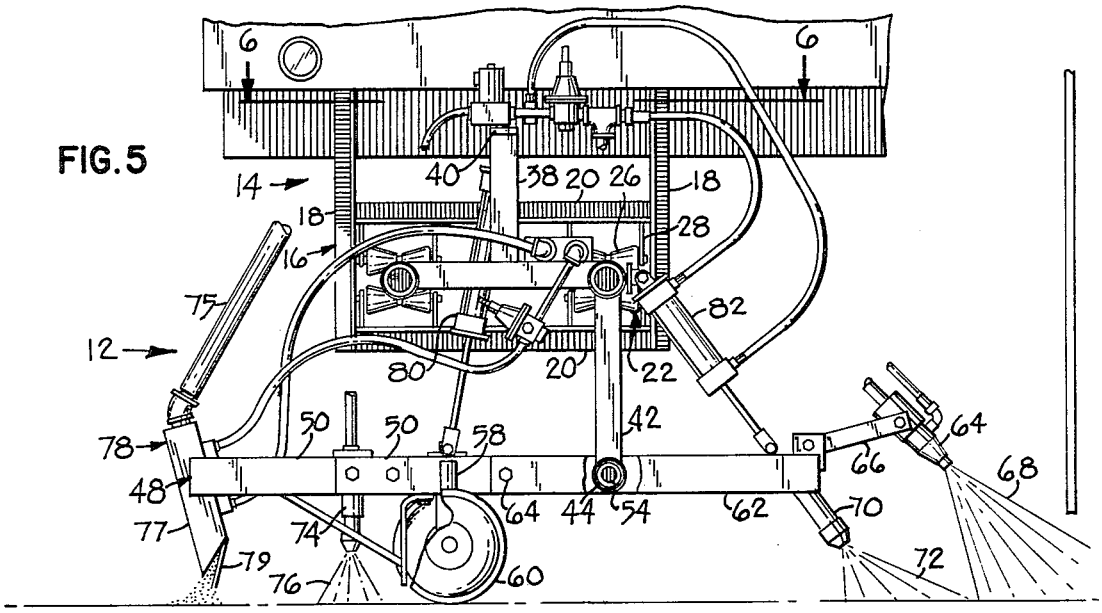
FIG. 6
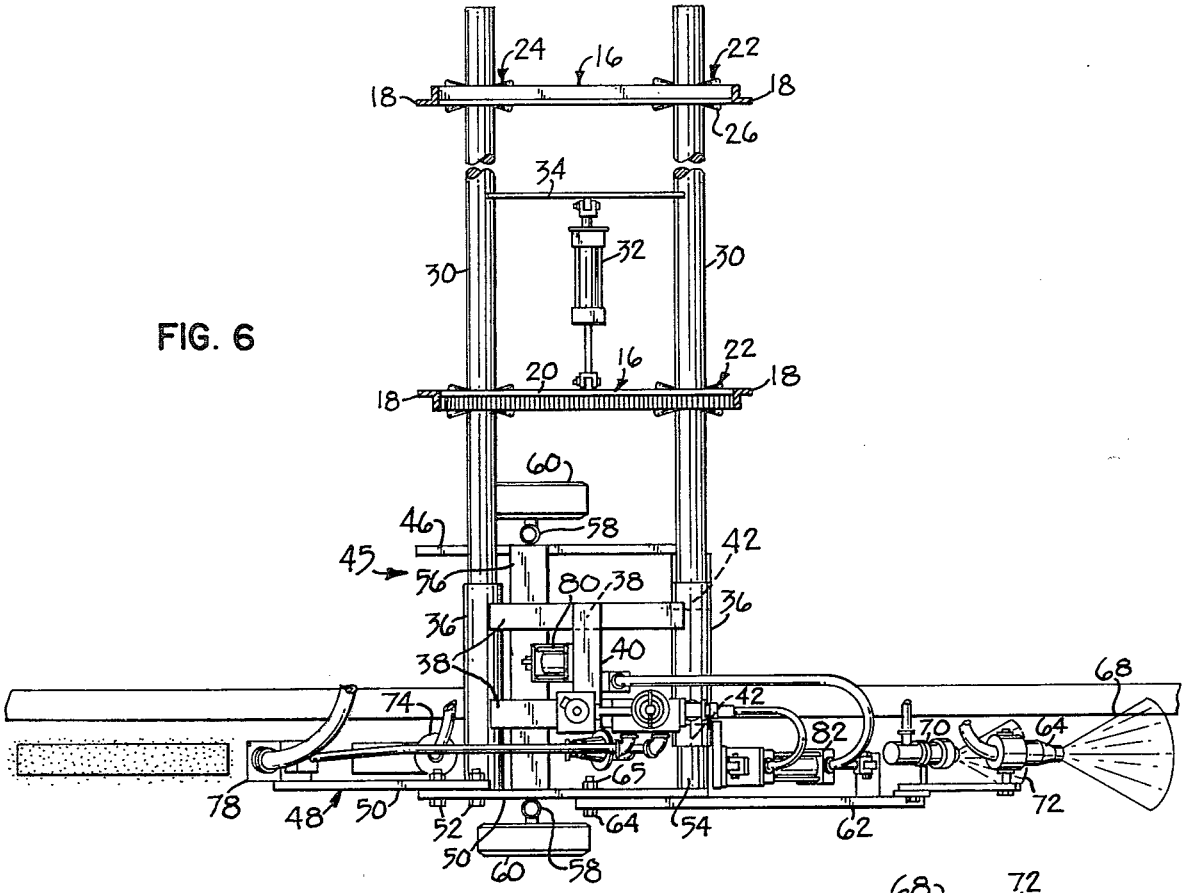
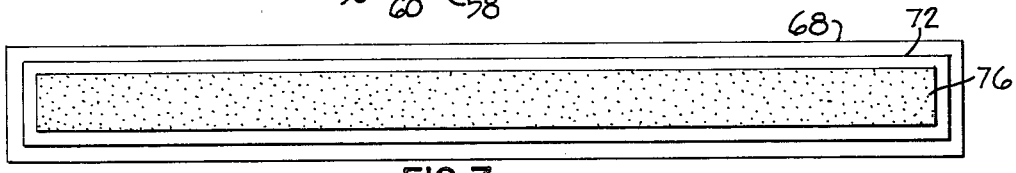
FIG. 7

HIGHWAY STRIPING METHOD AND APPARATUS

This is a continuation of application Ser. No. 832,642, filed Sept. 12, 1977, now abandoned.

BACKGROUND OF THE INVENTION

1. Field of the Invention

The present invention relates in general to a method and apparatus for applying paint stripes or the like to highways or other paved surfaces. An aspect of the invention relates to a method and apparatus particularly suited for applying to such surfaces a curable epoxy coating composition having first and second components.

2. Description of the Prior Art

It is well known to apply paint stripes or the like to a paved surface, such as a highway, to mark that surface for various purposes. A common example of the use of such paint stripes are those used to mark highways, streets, and other roadways into lanes for vehicular traffic control. The particular method and apparatus used to apply such stripes to the paved surface depends to some degree on the specific type of coating composition being utilized for the highway stripes. Conventionally, when applying the usual highway-type paint compositions, various types of nozzles have been utilized for simply spraying the paint composition intermittently onto the highway to form the stripes. Such equipment generally includes a truck having a paint applying nozzle mounted thereon, and also often includes a dispenser for dropping glass beads or other reflective material onto the paint after it has been applied to the surface. Alternatively, the glass beads are sometimes incorporated into the paint composition before it is sprayed out onto the roadway surface. In any event, conventional highway striping methods and apparatus generally involve equipment for both spraying the highway marking composition and incorporating glass beads with that composition.

The preparation of the paved surface prior to receiving the marking composition has not received a great deal of attention when applying conventional highway marking compositions. Generally, conventional highway striping paint compositions must be applied in fair, dry weather. Rainy conditions cause such paint compositions to smear or run. Furthermore, other types of highway marking compositions, such as modified chlorinated-rubber type coatings, are also difficult to apply to damp roadway surfaces. This requires either careful preparation of the roadway surface or limiting the time in which the striping operations are carried out to those prevailing during fair weather conditions.

In applicant's prior U.S. patent application, Ser. No. 635,694, entitled "Method of Marking Paved Surfaces And Curable Two Part Epoxy Systems Therefor," filed Nov. 26, 1975, applicant has disclosed an improved highway coating composition which exhibits a greatly improved combination of properties over the highway marking compositions conventionally used; for example, good adhesion to road surfaces, ability to be applied under a wide variety of ambient temperature and road surface conditions (including cold weather, the presence of moisture, etc.), minimal solvent hazards during application, good retention of reflectorizing fillers (e.g. glass beads), long term weather-resistance, good sprayability and flowability, resistance to chemical attack by water or de-icing salts, good wetting action, flexibility, and the ability to be applied without any special chemical priming of the road surface. This coating composition further exhibits the ability to become tack-free within a short period of time under any of the aforementioned road surface conditions. Applicant's novel coating composition comprises a curable, two component epoxy system in which the components must first be mixed together before their application to a paved surface.

SUMMARY OF THE INVENTION

Accordingly, the present invention contemplates providing a method and apparatus which takes full advantage of the improved combination of properties described previously. Furthermore, the invention seeks to provide a method and apparatus which are extremely versatile in terms of the conditions under which they may be used, provided that the coating composition to be applied (whether one- or two-part) has the requisite properties (e.g. lack of sensitivity to attack by water).

The apparatus of the inventor includes a movable vehicle suitable for traveling over a paved surface. The movable vehicle carries cleaning means for cleaning a first longitudinally extending portion of the paved surface which is to be coated. The cleaning means includes a nozzle for applying a water spray to the first portion, and a second nozzle for applying a pressurized air blast to the first portion of the paved surface. The first and second nozzles are sequentially operative to wet the first portion and then at least partially blow the water applied to the first portion to the sides thereof prior to the coating of the first portion. In addition, a third nozzle is carried by the vehicle for applying a pressurized flow of the coating composition to the first portion of the paved surface after the cleaning thereof. Moreover, control means responsive to the movement of the vehicle are provided for controlling the operation of the first, second and third nozzles to coat the first portion of the paved surface as the vehicle moves thereover.

BRIEF DESCRIPTION OF THE DRAWINGS

The present invention will be described hereafter in conjunction with the following drawings, wherein like numerals represent like parts, in which;

FIG. 5 is a side elevational view of a wheeled carriage carried on the movable vehicle, which carriage forms a part of the coating apparatus according to the present invention;

FIG. 6 is a top plan view of the wheeled carriage illustrated in FIG. 5, shown removed from the movable vehicle;

FIG. 7 is a top plan view of a highway stripe made in accordance with the teachings of the present invention.

DESCRIPTION OF A PREFERRED EMBODIMENT

Figure 1:
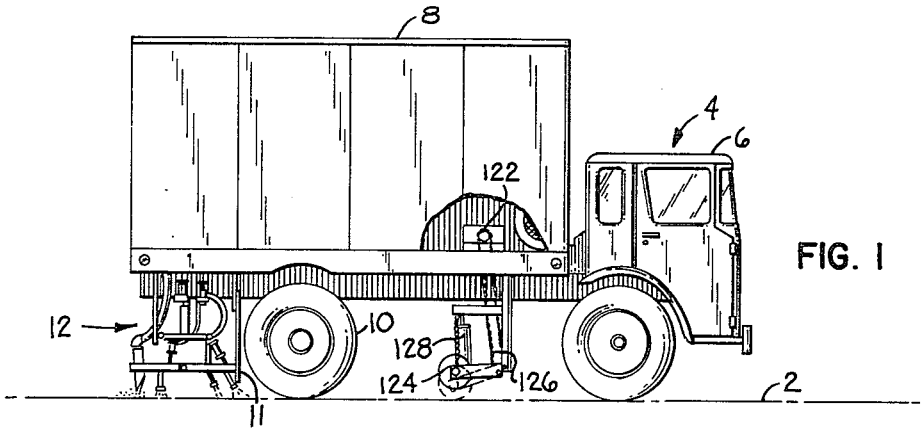
FIG. 1 is a side elevational view of a novel coating apparatus according to the present invention including a movable vehicle for traveling over the paved surface.

The preferred embodiment of this invention is particularly well-suited to the application of a two-component epoxy system of the type disclosed in applicant's prior U.S. patent application Ser. No. 635,694, filed Nov. 26, 1975. This two-part system has as its "Part A" a curable liquid vicinal epoxide, preferably a polyglycidyl ether of a polyhydric alcohol (e.g. a polyhydric phenol). The "Part B" (hardener or co-curative part) comprises a 90:10 to 10:90 (by weight) blend of aliphatic and cycloaliphatic polyfunctional amines (e.g. diamines). The ratio of free epoxide equivalents to active hydrogen-bearing amine equivalents in the resulting blend typically ranges from 1:1 to about 1.5:1, which may, however, work out somewhat differently on a volume basis (e.g. a 2:1 ratio of B:A). The curing and adhesion properties and other chemical properties of a two-epoxy system, as will be explained subsequently, are not adversely affected by the presence of the water used in the road surface cleaning step of the method of this invention.

The preferred vehicle-mounted apparatus of the invention can be divided, purely for convenience of description, into three interrelated groups of elements.

(1) the timer group (see, for example, elements 110, 112, 114, and 116 of FIGS. 1 and 8) which is used for intermittent striping operation by providing input to various control mechanisms but may otherwise be disengaged;

(2) the supply, storage and control group, (see, for example, elements 90 through 108 of FIGS. 2 and 8) which contains all the equipment and materials needed to supply or support the operation of the cleaner-applicator (or "carriage"); and (3) the cleaner-applicator or "carriage" (see particularly FIGS. 5 and 6) which is controlled by the supply, storage and control group and is supplied with (a) water, (b) pressurized air, (c) the coating composition, and, optionally but preferably (d) reflectorizing elements such as glass beads. This carriage, as will be explained subsequently, is constructed and arranged to apply a water spray followed promptly by an air blast to prepare the road surface for coating. Depending upon the size of the carriage and the rate of movement of the vehicle and with a longitudinally extended carriage mounted on a slow-moving vehicle, the time elapsed from water spray to coating and/or glass bead application (viewed from a fixed point on the road surface) could be as much as ten or twenty seconds. Using a short carriage on a fast-moving vehicle, this time factor could be as short as about 0.05 second. More typically, the time from water spray to bead application will range from about 0.2–2 seconds.

Although the apparatus according to the present invention is particularly suited for applying a two part coating composition as disclosed in applicant's prior U.S. patent application, Ser. No. 635,694, entitled "Method of Marking Paved Surfaces and Curable Two-Part Epoxy Systems Therefor," which application is hereby incorporated by reference the novel coating apparatus of the present invention may be used to apply other suitable coating compositions with the requisite properties to paved surface 2. If the coating composition is a one-part rather than two-part system, the "supply, storage and control group" of elements can be simplified in a manner which will be apparent to those skilled in the art, e.g. the mixing and some of the metering equipment, as well as separate storage and supply lines for "Part B" can be eliminated. For flexibility of operation, however, all of the two-part storage, supply, metering, and blending equipment are preferably retained, so that the operator can use either one-part or two-part systems in the method.

Referring to FIG. 1, an apparatus for applying a two component, curable coating composition to a paved surface 2 comprises a truck 4 suited for traveling over paved surface 2. Truck 4 comprises a cab 6 and an enclosed trailer portion 8. Although a truck 4 is preferably used in the present invention, any type of movable vehicle capable of traveling over paved surface 2 at an appropriate speed could be utilized; the particular type of movable vehicle used is not critical to the present invention.

Referring now to FIGS. 5 and 6, a wheeled carriage, generally indicated at 12, is mounted to truck 4 immediately behind the rear wheels 10 of truck 4. A downwardly extending flexible flap 11 is positioned between carriage 12 and the rear wheels 10. Carriage 12 carries suitable equipment for applying the coating composition to paved surface 2 as the truck 4 moves thereover. Carriage 12 is also movably attached to truck 4 by a support structure 14.

Support structure 14 comprises two transversely spaced end frames 16 positioned respectively at opposite sides of truck trailer 8. End frames 16 are identical and comprise two vertical and longitudinally spaced L-shaped beams 18 rigidly attached at their upper ends, as by welding, to the bottom of trailer 8. Two horizontal and vertically spaced L-shaped beams 20 extend between and rigidly connect the beams 18 of each end frame 16. Beams 20 are vertically spaced apart a sufficient distance to mount first and second roller pairs 22 and 24 therebetween in a longitudinally spaced manner. Each of the roller pairs 22 and 24 comprise identical V-shaped rollers 26 rotatably connected to beams 20 by vertically extending side flanges 28. The rollers 26 in each of the roller pairs 22 and 24 are vertically spaced apart a sufficient distance for movably supporting a portion of carriage 12 as will be described hereafter. In addition, the first roller pair 22 and the second roller pair 24 in one of the end frames 16 are longitudinally aligned with their counterparts in the opposite end frame 16.

Carriage 12 further comprises two horizontal and longitudinally spaced support beams 30 each having a cylindrical configuration to be matingly received between the rollers 26 of the first and second roller pairs 22 and 24 respectively. By virtue of such an engagement with roller pairs 22 and 24, each of the beams 30 is transversely movable or slidable relative to truck trailer 8. This allows carriage 12 to be precisely positioned over whatever portion of paved surface 2 that one desires to coat. A hydraulic cylinder 32 extends between one of the L-shaped beams 20 on trailer 8 and a flange 34 fixed between both of the support beams 30 for effecting the transverse adjustment of the beams 30.

Two cylindrical sleeves 36 are respectively slidably engaged over the ends of support beams 30 and are releasably coupled thereto by means of a pin (not shown) or other locking device extending through sleeves 36 into the corresponding beam 30. The sleeves 36 are further integrally connected together by means of two spaced longitudinally extending braces 38. Longitudinal braces 38 are further reinforced by two upwardly extending posts 39 connected at their upper ends by a cross brace 40. The forward-most sleeve 36, is, the one closest to the front of truck 4, is provided with two transversely spaced downwardly extending beams 42. The beams 42 are rigidly connected at their bottom ends by means of a horizontally extending cylindrical sleeve 44. Sleeve 44 acts as a pivot point for a portion of the wheeled carriage 12 as will be described hereafter.

Carriage 12 further includes a substantially U-shaped support frame 45 having a first side wall 46 transversely spaced from a second side wall 48. Side walls 46 and 48 are rigidly connected together at their forward ends by means of a cylindrical member 54 which is designed to be rotatably received inside sleeve 44. Side wall 48 comprises two longitudinally extending plates 50 overlapped at one end where they are rigidly connected together by bolts 52. Alternatively, side wall 48 could be formed as a single planar plate in the manner of side wall 46. Side walls 46 and 48 are further connected together by a transverse cross bracket 56 which serves to reinforce carriage 12. In addition, a longitudinally extending planar support plate 62 is pivotably mounted on side wall 48 by a pin or bolt 64. Pin 64 passes through support plate 62 and side wall 48 to terminate in a threaded outer end engaged by a nut 65 to prevent withdrawal of the pin 64 from plate 62 and side wall 48.

Two downwardly extending sockets 58 are attached to the outside surfaces of side walls 46 and 48 adjacent to the ends of cross bracket 56. Sockets 58 are shaped to receive a swivel joint through which two wheels 60 are connected to support frame 45 to movably support carriage 12 on paved surface 2. Although two wheels 60 are preferred in supporting carriage 12, only one wheel 60 would be necessary if it were sufficiently sized relative to carriage 12 to adequately support the weight thereof.

Support plate 62 has a first nozzle 64 rigidly mounted thereon by means of a bracket 66. Nozzle 64 is downwardly oriented to apply a pressurized water spray 68 to paved surface 2 as will be described in more detail hereafter. Similarly, a second nozzle 70 is rigidly mounted on support plate 62 and is also downwardly oriented to apply a pressurized air blast 72 to paved surface 2. In a similar manner, the side wall 48 of support frame 45 is provided with a material applying nozzle 74 which sprays a pressurized flow of the coating composition 76 onto the paved surface 2. Nozzles 64, 70 and 74 preferably comprise conventional types of pressurized spray nozzles. In particular, all of the nozzles 64, 70 and 74 are preferably Graco airless guns. In addition, a glass bead applicator 78 comprising a hollow tube 77 is rigidly mounted at the rear end of side wall 48 for dropping a plurality of glass beads or other reflective material onto the coating composition after it has been applied to surface 2. The flow of glass beads through applicator 78 is not pressurized, but is merely a gravity flow controlled by means of a pivotable trap door 79 at the bottom end of applicator tube 77.

Carriage 12 is shown in FIG. 5 in an operative coating position having wheels 60 in engagement with paved surface 2, and support plate 62 disposed in a straight line relationship with side wall 48, thereby orienting all the nozzles on carriage 12 in their proper angular orientation relative to paved surface 2. Typically, coating or striping of the paved surface 2 will occur when carriage 12 is in this operative position and truck 4 is traveling at 6–8 miles per hour. However, when it is desired for truck 4 to travel at a normal speed, such as 55 mph, as when traveling cross country between different job sites, carriage 12 must be moved upwardly relative to truck 4 to an inoperative transport position to lift wheels 60 out of engagement with paved surface 2.

Two hydraulic cylinders 80 and 82 are provided to lift carriage 12 to its inoperative transport position. The first cylinder 80 is pivotably connected between cross brace 40 and the cross bracket 56 on the U-shaped support frame 45. The second cylinder 82 is pivotably connected between one of the beams 38 and support plate 62. Cylinders 80 and 82 are designed to be simultaneously activated to draw the piston rods into the cylinders. When this occurs, support frame 45 will pivot upwardly until wheels 60 clear paved surface 2 with the cylindrical member 54 rotating inside sleeve 44, and support plate 62 will pivot upwardly around pivot pin 64. Thus, support frame 45 and support plate 62 will be disposed in a V orientation relative to one another when carriage 12 is lifted into its inoperative transport position.

Figure 3:
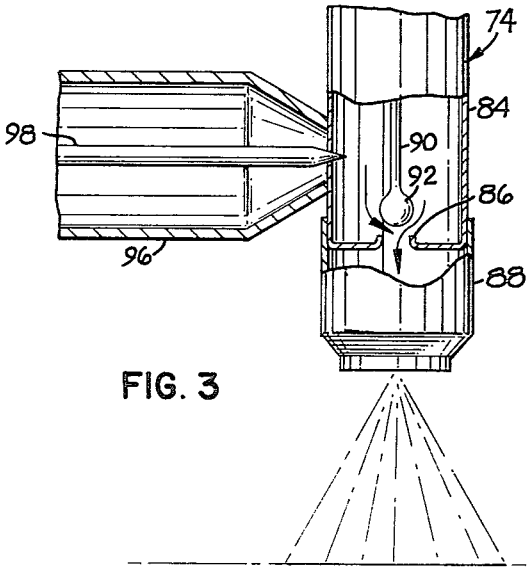
FIG. 3 is a side elevational view of a nozzle for applying the coating composition to the paved surface, showing a material applying valve in an open position.
Figure 4:
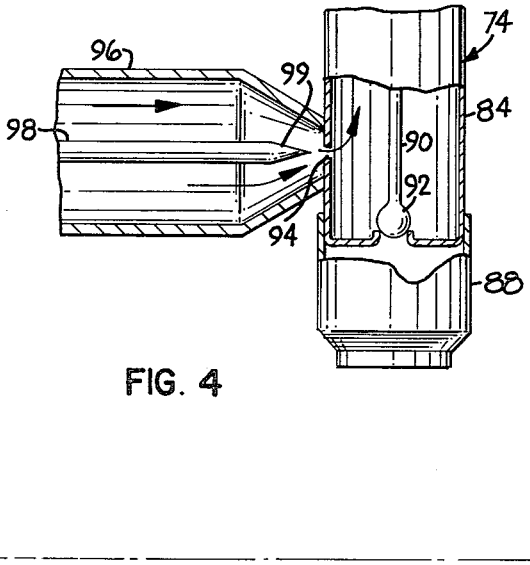
FIG. 4 is a side elevational view of the nozzle illustrated in FIG. 3 for applying the coating composition to the paved surface, showing a flush valve in an open position.

Referring now to FIGS. 3 and 4, material applying nozzle 74 is shown in more detail. Nozzle 74 comprises a downwardly extending tube 84 having an outlet opening 86. A retaining member 88 is mounted on the lower end of tube 84 around opening 86 and supports the nozzle spray head (not shown) of nozzle 74. A material dispensing needle valve 90 having a valve head portion 92 suitable for closing outlet opening 86 is provided inside tube 84. Furthermore, an additional outlet opening 94, provided in the side of nozzle tube 84, is connected with a flush tube 96 extending at a right angle relative to tube 84. A flush needle valve 98 having a valve head 99 is provided for opening and closing flush opening 94 in tube 84. The function of the material dispensing valve 90 and flush valve 98 will be described in more detail hereafter.

Figure 2:
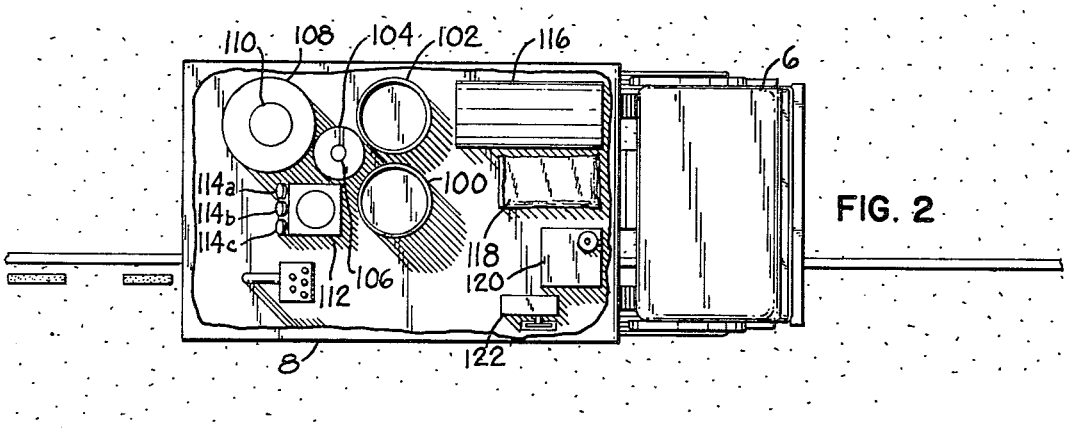
FIG. 2 is a top plan view of the movable vehicle described in FIG. 1, with a portion thereof broken away.

Referring now to FIG. 2, the truck trailer 8 is provided with first and second supply tanks 100 and 102 for respectively holding the two components which, when combined, make up the curable coating composition that is to be applied to paved surface 2. Supply tank 100 holds component "A" while supply tank 102 holds component "B," with the "A" and "D" terminology for the components referring to the same substances as in applicant's above-referenced patent application. Suitable heating elements (not shown) are provided around each of the tanks 100 and 102. These heating elements cooperate with in-line heaters (not shown) in the component supply lines to heat the components therein to a temperature in the range of 165°–190° F. A flush tank 104 also is provided in trailer 8 for holding a supply of a solvent solution suitable for flushing and cleaning the nozzle 74 which applies the coating composition to paved surface 2. A pump 106 is operatively connected to tank 104 for pumping the solvent solution therefrom. In addition, a water tank 108 is carried by trailer 8 for holding a supply of water. A pump 110 is connected to tank 108 and pumps the water held in tank 108 under pressure to nozzle 64.

A conventional Graco type pump 112 having three identical and separate fluid pumping cylinders 114*a–c* is carried in the truck trailer 8. Pump cylinders 114 *a* and *b* are both connected to supply tank 100, and pump cylinder 114*c* is connected to supply tank 102. Such a pump arrangement enables component "A" to be pumped at a 2:1 ratio relative to component "B" when pump 112 is activated. Truck trailer 8 also includes an air compressor 116, a supply 118 of glass beads or other conventional reflective material, an electrical generator 120 for providing power to the heating elements used to heat the "A" and "B" components, and an adjustable timer 122. Timer 122 is driven in accordance with the movement of vehicle 4 by a timing wheel 124 which rolls along the paved surface 2 and drives timer 122 through a chain linkage 126. A hydraulic cylinder 128 is connected to timing wheel 124 to lift the timing wheel 124 from its dotted line (FIG. 1) operative position in engagement with paved surface 2 to its inoperative solid line position out of engagement with surface 2. Timing wheel 124 is placed into its inoperative position when carriage 12 is raised to its inoperative position to allow high speed transport of vehicle 4.

Figure 8:
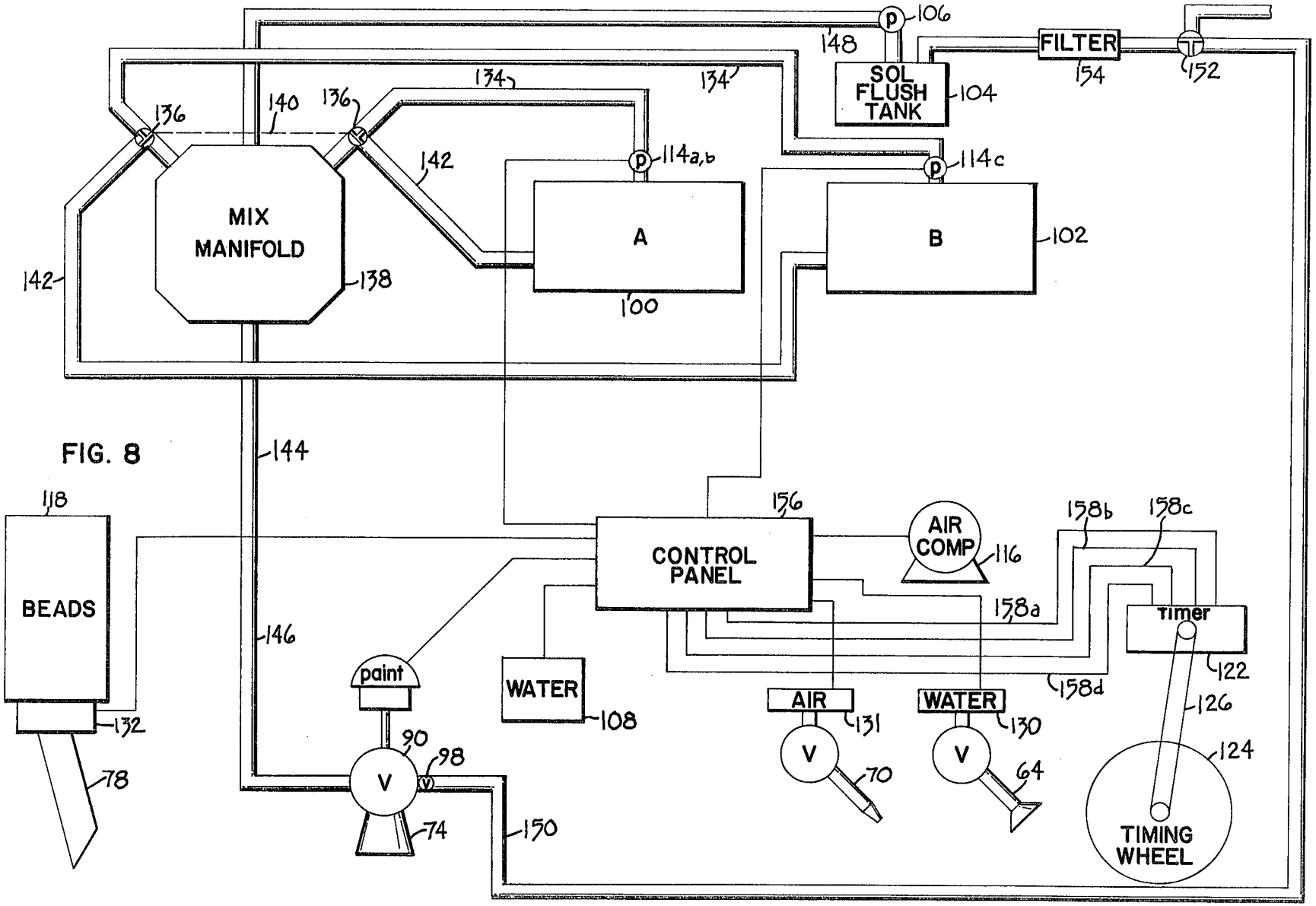
FIG. 8 is a diagrammatic view of the coating apparatus according to the present invention.

Referring now to FIGS. 7 and 8, each of the nozzles 64 and 70 as well as the glass bead applicator 78 are respectively provided with conventional air operated valves 130–132 for controlling the flow therethrough. In addition, the material applying valve 90 and the flush valve 98 in the material applying nozzle 74 are also preferably air operated valves similar to the valves 130–132. Each of the supply tanks 100 and 102 are connected by a hose 134, containing a three-way valve 136, to a mix manifold 138 where the components "A" and "B" are brought together to form the curable coating composition. The valves 136 are mechanically coupled together, as by a rack and pinion linkage 140, so that operation of one valve 136 automatically causes the other valve 136 to assume an identical position. In addition, a recirculating line 142 leads from each of the three-way valves 136 back to the supply tanks 100 and 102.

Mix manifold 138 is operatively connected by a supply line 144 to the material applying valve 90 of the spray nozzle 74. A static in-line mixer 146, of a conventional type marketed under the trade name of Kenics, forms a portion of supply line 144 and thoroughly mixes the components "A" and "B" together as they travel through line 144 from mix manifold 138 to valve 90. In addition, solvent supply line 148 is connected between the solvent flush tank 104 and mix manifold 138. A solvent disposal line 150 leads from the flush tube 96 of flush valve 98 back to a three-way valve 152. In turn, valve 152 leads respectively either to the solvent flush tank 104 after first passing through a filter 154, or alternatively to a dump bucket (155).

A central control panel 156 is provided to activate the various valves and pumps comprising the apparatus of the present invention. Certain of the valves, such as the valves 90 and 130–132 which control the flow through the nozzles 64, 70, and 74 and the glass bead applicator 78, will be operated automatically by control signals generated in timer 122. The remaining valves, including the recirculating valves 136 and flush valve 98, as well as the various pumps and the hydraulic cylinders 80, 82 and 128 for raising carriage 12 and the timing wheel 124, will be operated manually by activating appropriate switches on control panel 156. Panel 156 is also provided with a switch on control panel 156. Panel 156 is also provided with a switch to override the automatic operation of the material applying valve 90 whenever the flush valve 98 is activated.

In the operation of the apparatus according to the present invention, as vehicle 4 travels along paved surface 2, timing wheel 124 drives the timer 122 through chain 126. Assuming that the timer is set to apply a series of longitudinally spaced stripes to the paved surface, timer 122 will generate a series of time varying control signals along the electrical control lines 158 *a–d* leading to control panel 156. These control signals will be applied through control panel 156 to sequentially operate the valves 130, 131, 90 and 132.

For example, as vehicle 4 travels along the paved surface 2, control panel 156, under the control of timer 122, will first activate or open the air valve 130 by allowing compressed air generated in compressor 116 to be applied to the valve. This allows water pumped under high pressure by pump 110 from the supply tank 108 to be sprayed out onto the paved surface 2 through nozzle 64. Thereafter, valve 131 for air nozzle 70 is opened allowing compressed air, generated in the compressor 116, to be sprayed through nozzle 70 onto that portion of the paved surface previously wetted by nozzle 64. The air blast from nozzle 70 will blow the water applied to the paved surface to the side of the area that is to be striped, but will not entirely dry that area which still remains somewhat damp. In effect, the air blast will create a trough-like slightly damp area in that portion of the pavement wet by nozzle 64. The combined effect of the water spray and air blast is, of course, to clean the pavement immediately prior to the coating thereof.

Subsequently, the control panel 156 activates valve 90 allowing the coating composition previously mixed in the mix manifold 138 to be sprayed out under pressure through the material applying nozzle 74 onto the area previously cleaned by nozzles 64 and 70. The coating composition spray is pressurized by means of the pump cylinders 114 *a–c* which both pump and pressurize the "A" and "B" components. Finally, valve 132 of the glass bead applicator 78 will be opened by control panel 156 allowing a plurality of glass beads to fall onto the coating composition just applied to paved surface 2. Because the trap door 79 of the glass bead applicator 78 is only intermittently operated by valve 132 under the control of timer 122 a reservior of glass beads will build up in applicator tube 77 during the periods of nonoperation as applicator tube 77 is continuously connected by a hose 75 to the glass bead supply 118. Thus, when trap door 79 is finally opened, the glass beads will fall by gravity onto the coating composition in relatively large amounts due to the reservoir that has built up. This concentrates the glass beads near the top of the coating composition for maximum reflectivity, but also allows some beads to percolate down through the coating composition to form additional layers of glass beads which will be uncovered as the coating composition material is worn away.

Referring now to FIG. 7, both the width and length of the water spray 68, air blast 72 and material spray 76 are progressively smaller. Such an arrangement gives optimum results in applying the coating composition to paved surface 2. However, the width and length of the sprays could be identical if so desired. Similarly, although timer 122 is preferably set to apply longitudinally spaced stripes to the paved surface, it could be so adjusted such that the control signals provided along lines 158 *a–d* are continuous. Thus, the valves 130, 131, 90 and 132 would be continuously opened to apply one continuous stripe to the paved surface 2, as when applying a side line to the side of a highway.

During the striping operation, the coating composition circulating through the mix manifold 138 and through the material applying nozzle 74 collects and gells in small quantities as fittings in the lines. To keep the mixing manifold 138, static in-line mixer 146, supply line 144, and nozzle 74 clean, solvent must be circulated for a period of ten to fifteen minutes through this system when it is not used for striping to clean the system. In such a flushing operation, the operator of the coating apparatus manually throws a switch on control panel 156 activating the pump 106 for pumping solvent from the solvent flush tank 104, through hose 148 and mix manifold 138, to the hose 144 and the material applying nozzle 74. At this time, the material applying valve 90 is closed and the flush valve 98 opened. Consequently, the flush solvent applied to nozzle 74 will exit therefrom to the solvent disposal line 150 and travel from there through valve 152 to a filter 154 where the gelled particles of the coating composition are collected. Thereafter, the filtered solvent is returned to the solvent flush tank 104 for reuse.

The pot life of the blended part "A" and part "B" components in mix manifold 138 at their operating temperatures of 165°-190° F. is approximately forty seconds. If there is any substantial delay or interruption in the striping operation, the flush cycle must be activated. In this situation, the three-way valve 152 should be positioned such that the flush solvent removing the degraded part "A" and "B" components from the coating system is routed to a dump bucket for disposal. This orientation for valve 152 might also be selected during start up operations when the quality of the coating composition has not stabilized, or when the coating composition should be disposed of for any other reason.

During the initial start up of the apparatus and before the part "A" and part "B" components have reached their stable preselected temperatures, the components are preferably circulated through the lines 134, through valves 136 and back to the tanks 100 and 102 through recirculation lines 142. In such an event, the valves 136 are positioned to connect together the lines 134 and 142 to effect the recirculation described above. Such recirculation is also preferably automatically initiated if for any reason the striping operation is temporarily interrupted, such as by a lunch break for the striping crew. In this case, it is desirable to continuously recirculate the components "A" and "B" from their heated supply tanks 100 and 102, through the valves 136 and the recirculation lines 142, and back to the supply tanks to prevent the part "A" and "B" components from cooling and then thickening.

When the vehicle 4 is traveling at its normal striping speed of from six to eight miles per hour, a distance of approximately eleven inches is preferred between the airless coating nozzle 74 and the glass bead applicator 78. This distance is preferred and is selected to ensure that the glass beads are dropped onto the coating composition while it is still fluid, thus ensuring proper percolation of the beads down through the coating composition. The distance between the high pressure water nozzle 64 and the material nozzle 74 should be approximately forty-six inches. This latter distance does not appear to be critical, but the water nozzle 64 and air blast nozzle 66, by which the pavement is cleaned, should be mounted on the same truck as the material nozzle 74, and be sequenced to clean the area which is to be striped immediately before the coating operation.

Because of the novel nature of the components of the coating composition, which components are substantially immiscible with water but not sensitive toward water, the presence of a slight film of water on the area to be coated does not interfere with the coating operation or the curing of the coating composition. The use of a water spray and air blast to clean the surface immediately prior to the coating thereof is a novel feature of the method and apparatus of the present invention occasioned by the two part epoxy system of applicant's above-referenced U.S. application.

Many modifications of the method and apparatus described herein would be obvious to one skilled in the art. Thus, the scope of the present invention is to be limited only by the scope of the appended claims.

I claim:

1. An apparatus suitable for applying a curable coating composition having first and second components to a first longitudinally extending portion of a paved surface, comprising a movable vehicle suitable for traveling over the paved surface; cleaning means carried by said vehicle for cleaning the first portion of the paved surface, said cleaning means including a first nozzle for applying a water spray to the first portion, and a second nozzle for applying an air blast to the first portion, said first and second nozzles being sequentially operative to wet the first portion and then at least partially blow the water applied to the first portion to the sides thereof prior to the coating of the first portion of the paved surface; a third nozzle carried by said vehicle for applying a pressurized flow of the coating composition to the first portion of the paved surface after the cleaning thereof; and means responsive to the movement of said vehicle for controlling the operation of said first, second and third nozzles to coat the first portion of the paved surface as said vehicle moves thereover, wherein said first, second and third nozzles are carried by a wheeled carriage attached to said vehicle and positioned over the first portion of the paved surface, said carriage being movable vertically relative to said vehicle between a first position where said carriage engages the paved surface and a second position where said carriage is held out of engagement with the paved surface, wherein said carriage comprises a support frame pivotable about a first axis located on said vehicle and a support plate pivotable about a second axis located on said support frame, and further including means attached to the vehicle for respectively pivotting said support frame and support plate about their respective axes.

2. An apparatus according to claim 1, wherein said carriage is transversely moveable relative to said vehicle such that said carriage is precisely positionable over the first portion of the paved surface.

3. An apparatus suitable for applying a curable coating composition having first and second components to a first longitudinally extending portion of a paved surface, comprising a movable vehicle suitable for traveling over the paved surface; cleaning means carried by said vehicle for cleaning the first portion of the paved surface, said cleaning means including a first nozzle for applying a water spray to the first portion, and a second nozzle for applying an air blast to the first portion, said first and second nozzles being sequentially operative to wet the first portion and then at least partially blow the water applied to the first portion to the sides thereof prior to the coating of the first portion of the paved surface; a third nozzle carried by said vehicle for applying a pressurized flow of the coating composition to the first portion of the paved surface after the cleaning thereof; and means responsive to the movement of said vehicle for controlling the operation of said first, second and third nozzles to coat the first portion of the paved surface as said vehicle moves thereover, further including supply means for supplying the composition to said third nozzle, said supply means comprising first and second supply tanks for respectively holding the first and second components which when combined make up the composition; said first and second supply tanks being operatively connected to a mix manifold where the first and second components are brought together to form the coating composition, said mix manifold being operatively connected to said third nozzle for supplying thereto the composition formulated in said mix manifold, further including means for flushing said mix manifold and said third nozzle of gelled particles of the coating composition, and wherein said flushing means comprises a solvent flush tank for holding a supply of a flushing solvent, said solvent flush tank being operatively connected to said mix manifold, and said third nozzle including a flush valve operatively connected to a solvent disposal line, said flush valve having an open position where flush solvent applied to said mix manifold and said third nozzle passes therethrough into said solvent disposal line.

4. An apparatus according to claim 3, wherein said solvent disposal line is operatively connected in a closed loop back to said solvent flush tank through a filter.

5. An apparatus according to claim 3, wherein said solvent disposal line is provided with a valve means, said valve means having a first position where said solvent disposal line is operatively connected in a closed loop back to said solvent flush tank through a filter, and a second position where said solvent disposal line is connected to a solvent disposal means.

* * * * *